US010808580B2

(12) United States Patent
McCloy et al.

(10) Patent No.: US 10,808,580 B2
(45) Date of Patent: Oct. 20, 2020

(54) ELECTRICALLY-ACTUATED VCT LOCK

(71) Applicant: BorgWarner, Inc., Auburn Hills, MI (US)

(72) Inventors: Chad McCloy, Cortland, NY (US); Braman Wing, Ithaca, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/567,606

(22) Filed: Sep. 11, 2019

(65) Prior Publication Data

US 2020/0080449 A1 Mar. 12, 2020

Related U.S. Application Data

(60) Provisional application No. 62/730,134, filed on Sep. 12, 2018.

(51) Int. Cl.
*F01L 1/352* (2006.01)
*F01L 1/344* (2006.01)

(52) U.S. Cl.
CPC ..... *F01L 1/344* (2013.01); *F01L 2001/3522* (2013.01)

(58) Field of Classification Search
CPC ..... F01L 1/352; F01L 2001/3522; F01L 2013/101; F01L 2013/103; F01L 2820/031; F01L 2820/032
USPC ..... 123/90.15, 90.17
See application file for complete search history.

(56) References Cited

U.S. PATENT DOCUMENTS

| | | | |
|---|---|---|---|
| 6,250,265 | B1 | 6/2001 | Simpson |
| 6,263,846 | B1 | 7/2001 | Simpson et al. |
| 6,814,037 | B1 | 11/2004 | Smith et al. |
| 7,225,774 | B2 | 6/2007 | Watanabe et al. |
| 7,451,731 | B2 | 11/2008 | Eichenberg et al. |
| 8,468,988 | B2 | 6/2013 | Nishikiori et al. |
| 8,899,199 | B1 | 12/2014 | Waters |
| 2007/0056538 | A1 | 3/2007 | Simpson et al. |
| 2015/0260060 | A1 | 9/2015 | Fischer et al. |
| 2017/0198755 | A1* | 7/2017 | Brown ..... F16D 3/64 |
| 2017/0248047 | A1* | 8/2017 | Simpson ..... F01L 1/344 |
| 2018/0371963 | A1 | 12/2018 | Burke et al. |

FOREIGN PATENT DOCUMENTS

JP 2010-133272 A 6/2010

* cited by examiner

*Primary Examiner* — Jorge L Leon, Jr.
(74) *Attorney, Agent, or Firm* — Reising Ethington P.C.

(57) ABSTRACT

An electrically-actuated camshaft phaser including an electrically-actuated lock that includes a planetary gear assembly having a camshaft ring gear configured to be connected to a camshaft, a sprocket ring gear configured to receive rotational input from a crankshaft, and one or more planet gears engaging the camshaft ring gear and the sprocket ring gear, wherein the planetary gear assembly changes the angular position of the camshaft relative to the crankshaft; an electric motor, coupled to the planetary gear assembly, and a solenoid, wherein the electric motor controls the relative angular position of the crankshaft relative to the camshaft and the solenoid selectively moves a mechanical connection into locking engagement thereby preventing relative movement between the camshaft relative to the crankshaft.

11 Claims, 3 Drawing Sheets

ELECTRICALLY-ACTUATED VCT LOCK

RELATED APPLICATIONS

This application claims priority to U.S. Provisional Patent Application No. 62/730,134 filed Sep. 12, 2018 the contents of which are hereby incorporated in their entirety.

TECHNICAL FIELD

The present application relates to variable valve timing (VVT) and, more particularly, to variable camshaft timing (VCT).

BACKGROUND

Camshaft phasers can be used to implement VCT and allow angular displacement between a camshaft and a crankshaft in an internal combustion engine (ICE). Changing the angular position of the camshaft relative to the crankshaft can yield a number of performance improvements compared to ICEs using camshafts that are fixed relative to the crankshaft, such as improved cold starting. But sometimes it can be helpful to maintain the relative angular position of the camshaft relative to the crankshaft. Electrically-actuated camshaft phasers can maintain the angular position of the camshaft relative to the crankshaft by operating an electric motor that maintains the relative angular positions of the camshaft and the crankshaft. However, this involves supplying power to an electric motor to maintain this relationship. It would be helpful to maintain the angular position of the camshaft relative to the crankshaft without relying on an electric motor to do so.

SUMMARY

In one implementation, an electrically-actuated camshaft phaser and an electrically-actuated lock that includes a planetary gear assembly having a camshaft ring gear configured to be connected to a camshaft, a sprocket ring gear configured to receive rotational input from a crankshaft, and one or more planet gears engaging the camshaft ring gear and the sprocket ring gear, wherein the planetary gear assembly changes the angular position of the camshaft relative to the crankshaft; an electric motor, coupled to the planetary gear assembly, and a solenoid, wherein the electric motor controls the relative angular position of the crankshaft relative to the camshaft and the solenoid selectively moves a mechanical connection into locking engagement thereby preventing relative movement between the camshaft relative to the crankshaft.

DETAILED DESCRIPTION

Figure 1:
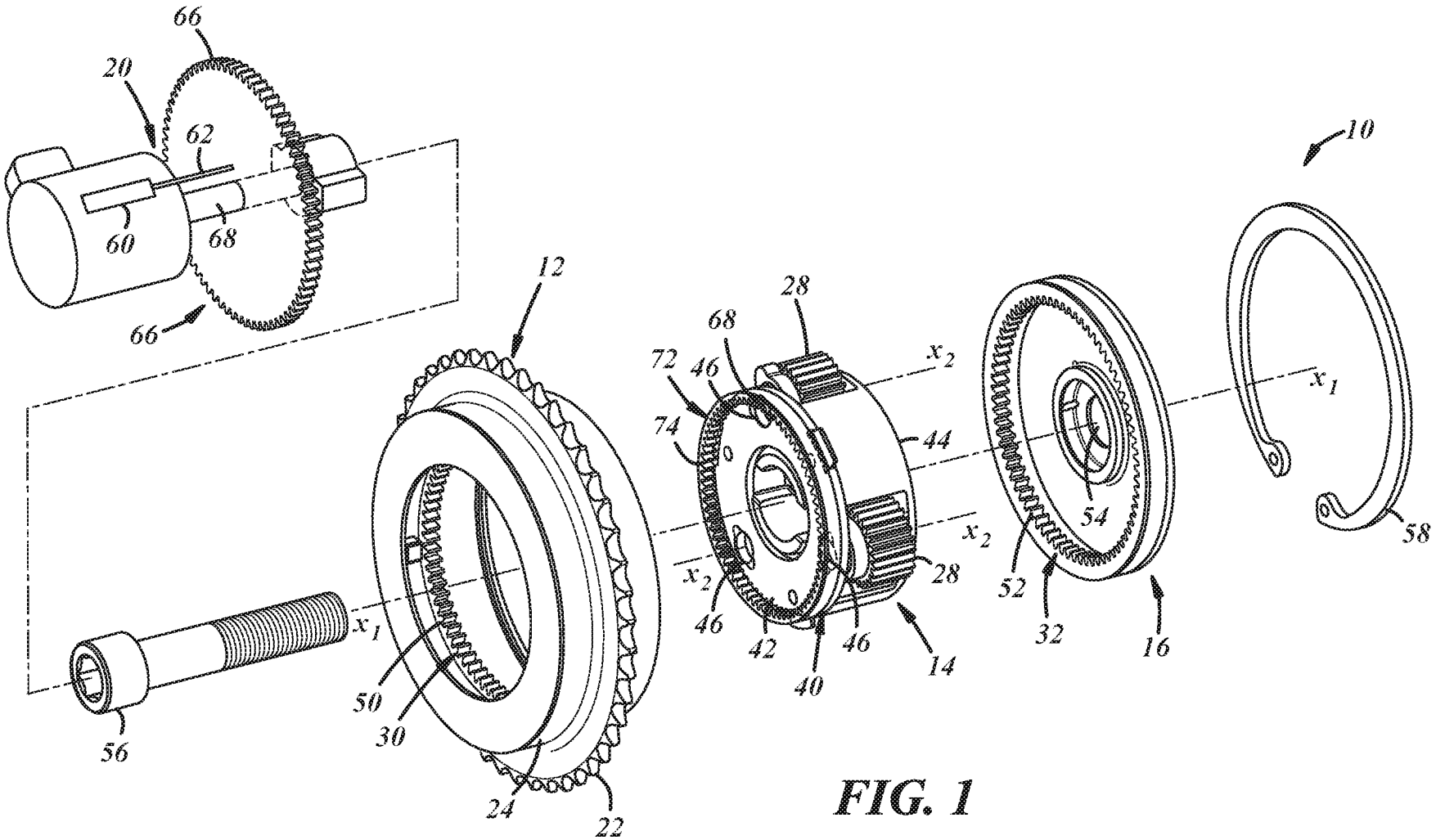
FIG. 1 is a perspective exploded view depicting an implementation of an electrically-actuated camshaft phaser and an electrically-actuated lock.

An electrically-actuated lock used with an electrically-actuated camshaft phaser can selectively prevent the phaser from changing the angular position of the camshaft with respect to the angular position of a crankshaft. The electrically-actuated lock can include a solenoid actuating a locking member that mechanically prevents relative motion between the angular position of the camshaft and the angular position of the crankshaft. A locking element can be coupled to an armature of the solenoid and electrical current can be selectively supplied to the solenoid to engage and disengage the locking element that couples two relatively movable portions of the electrically-actuated camshaft phaser. For example, an input of the camshaft phaser can be coupled to a crankshaft through an assembly of gears or an endless loop, such as a chain, and an output of the camshaft phaser can be coupled to a camshaft. The camshaft phaser can change the angular position of the output/camshaft relative to the input/crankshaft over an angular range, sometimes called a range of authority. The electrically-actuated lock can releasably link the input of the electrically-actuated camshaft phaser to the output of the electrically-actuated camshaft phaser through a mechanical connection that prevents the angular displacement of the camshaft/output relative to the crankshaft/input. The mechanical connection can be engaged regardless of the amount of angular displacement between the input and output over the range of authority. That is, the camshaft can be angularly displaced relative to the crankshaft to a fully-advanced position such that the camshaft phaser prevents further angular displacement using mechanical stops and the mechanical connection can be established by the electrically-actuated lock at the fully-advanced position. In contrast, the camshaft can be angularly displaced relative to the crankshaft to a fully-retarded position that is prevented from further angular displacement using mechanical stops and the mechanical connection can be established by the electrically-actuated lock at the fully-retarded position. Also, the mechanical connection can be established at any relative angular position between the camshaft and the crankshaft within the range of authority.

The locking element can be implemented in a variety of forms and in a variety of locations. In some implementations, the solenoid can use an armature moving in a linear direction while in other implementations a rotary motion may be used. And the mechanical connection between the input and output of the electrically-actuated camshaft phaser can be carried out using a variety of different mechanism designs, such as a friction clutch, a dog clutch, a lock pin, or a tapered tooth face clutch, to provide a few examples.

Apart from directly connecting the armature to the mechanical connection, a linkage can transmit force from the armature of the solenoid to the mechanical connection. In some implementations, the solenoid can be mounted in a location that is isolated from the mechanical connection and the force exerted by the solenoid can be transmitted through the linkage. The linkage can be a hydraulic pathway having a fixed volume of fluid that is in fluid communication with the armature of the solenoid and the mechanical connection. When the armature of the solenoid moves, it extends into the hydraulic pathway reducing the volume of the hydraulic pathway thereby displacing the fluid and transmitting force from the armature to the mechanical connection. In other implementations, the linkage can be a mechanical linkage that connects the armature of the solenoid to the mechanical connection. When current flows to the solenoid, the armature moves and communicates that motion to the mechanical connection through the mechanical linkage. It is possible to implement the mechanical link using a rigid sleeve, an elongated member, or a fork-shaped link.

The armature and the mechanical connection can work in conjunction with a biasing member that can help control locked/engaged or unlocked/disengaged of the mechanical connection. For example, when electrical power is received at the solenoid, the armature can overcome the force of a biasing member, such as a spring, and move the mechanical connection into a locking position and when electrical power is no longer supplied to the solenoid, the biasing member can return the mechanical connection to an unlocked position. It is also possible to bias the mechanical connection into a locking position with the biasing member. When electrical power is received at the solenoid, the armature can overcome the force of a biasing member, such as a spring, and move the mechanical connection into an unlocked position and when electrical power is no longer supplied to the solenoid, the biasing member can return the mechanical connection to a locked position. It is also possible to use a first solenoid to move the mechanical connection into locked/engaged position and a second solenoid to move the mechanical connection into an unlocked/disengaged position.

The solenoid that actuates the electrically-actuated lock can be mounted in various locations relative to the camshaft phaser. For instance, the solenoid can be included within an electric motor housing such that the armature of the solenoid, or a linkage coupled with the armature, extends outside of and beyond the electric motor housing. However, it is also possible to mount the solenoid outside of the electric-motor housing and adjacent the electrically-actuated camshaft phaser. Adjacent can mean in close proximity to the electrically-actuated camshaft phaser or it can mean directly coupled with the phaser. Other implementations can position the solenoid adjacent a camshaft end that is opposite to the camshaft end to which the electrically-actuated camshaft phaser is attached. A push rod can extend from the opposite camshaft end to the electrically-actuated camshaft phaser through a cavity in the camshaft. The armature of the solenoid can move the push rod linearly through the cavity along the axis of camshaft rotation to engage the mechanical connection that prevents relative angular displacement between the camshaft and the crankshaft. It is also possible to locate the solenoid within a housing containing the electrically-actuated camshaft phaser; in this implementation, a slip ring can be used to carry electrical power from a power source to the solenoid that rotates with the phaser during operation.

Control of the solenoid of the electrically-actuated lock can be implemented in a number of ways. Electrical current from the electric motor of the electrically-actuated camshaft phaser can be supplied to the solenoid and control of the solenoid can be directed by the electric motor. Or a separate, independent microcontroller can operate an electrical switch that controls the absence or presence of electrical current supplied to the solenoid independent from the camshaft phaser. This controller can be carried by a vehicle or by the electrically-actuated camshaft phaser so that the lock can be engaged independently from electric motor operation. And rather than supplying electrical power from the electric motor, the solenoid can be powered directly by an independent electrical source through the switch controlled by the microcontroller.

Apart from control of the electrically-actuated lock, the solenoid can be used to control other functions as well. Electrically-actuated camshaft phasers use mechanical gearboxes that can be supplied with a lubricating fluid, such as engine oil, from the ICE. The supply of this fluid to the electrically-actuated phaser can be controlled with the solenoid at the same time the solenoid controls locking/unlocking of the mechanical connection. When the solenoid places the mechanical connection in a locked condition preventing the angular displacement of the camshaft relative to the crankshaft, the solenoid can, at the same time, close a valve that stops the supply of lubricating fluid to the electrically-actuated camshaft phaser. When locked, the mechanical gearbox may not benefit from additional lubrication from the fluid supply because the gears of the gearbox may not be rotating. Selectively stopping the flow of lubricating fluid to the electrically-actuated camshaft phaser can increase the efficiency of the ICE. It is also possible to control the locking/unlocking of the mechanical connection independently from the flow of lubrication to the electrically-controlled camshaft phaser. The solenoid can be controlled to move its armature to one of three discrete positions. The first position can disengage the mechanical connection and permit lubricating fluid to flow to the electrically-controlled camshaft phaser. A first level of electrical current can be supplied to the solenoid moving the armature to a second position that closes the valve to the lubricating fluid preventing the flow of lubricating fluid to the electrically-controlled camshaft phaser. A second level of electrical current can be supplied to the solenoid moving the armature to a third position that both prevents the flow of lubricating fluid to the electrically-controlled camshaft phaser but also places the mechanical connection in a locked position. The control of the lubricating fluid and mechanical connection can be influenced by pulse width modulation (PWM) of the electrical current supplied to the solenoid.

Figure 2:
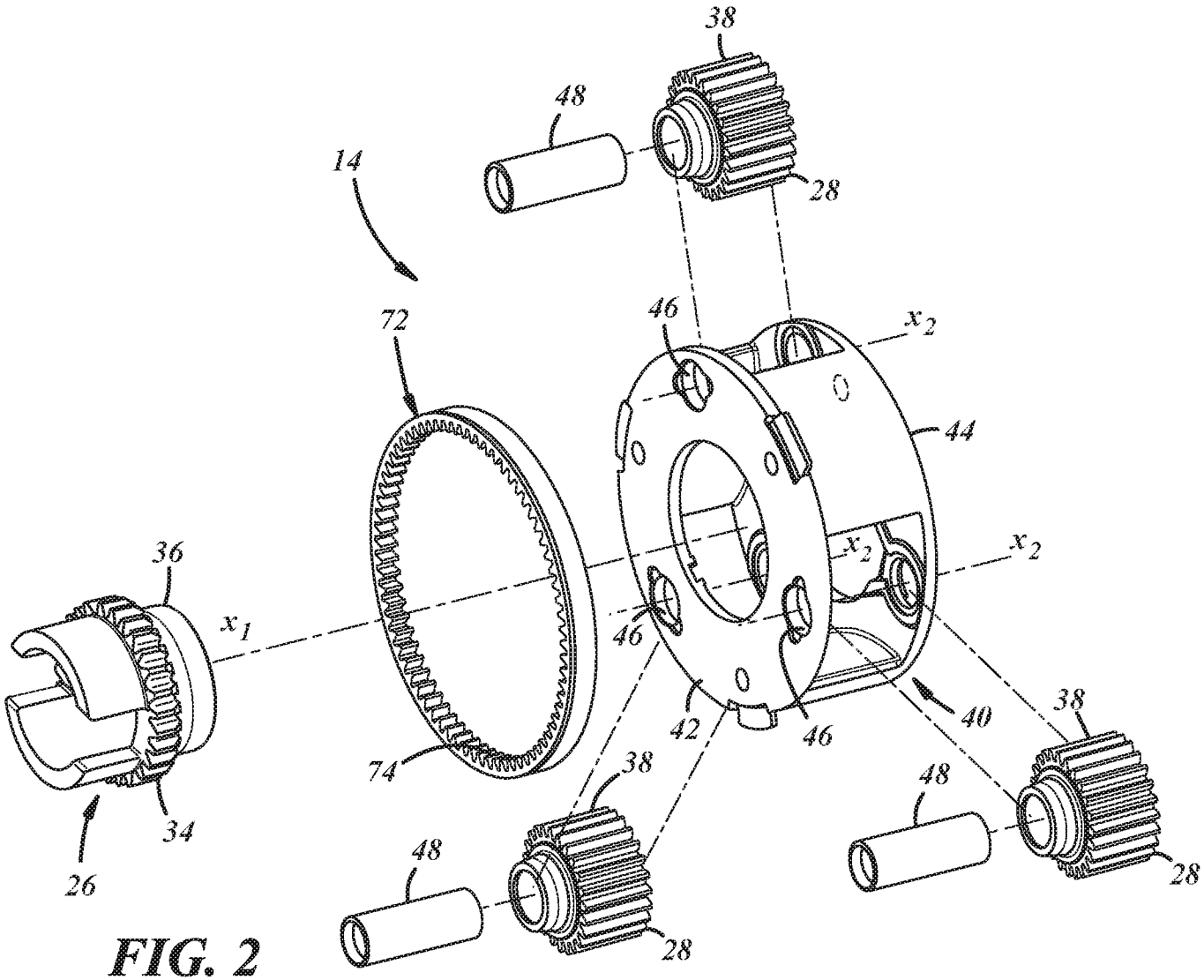
FIG. 2 is a perspective exploded view depicting part of an implementation of and electrically-actuated camshaft phaser used with an electrically-actuated lock.
Figure 3:
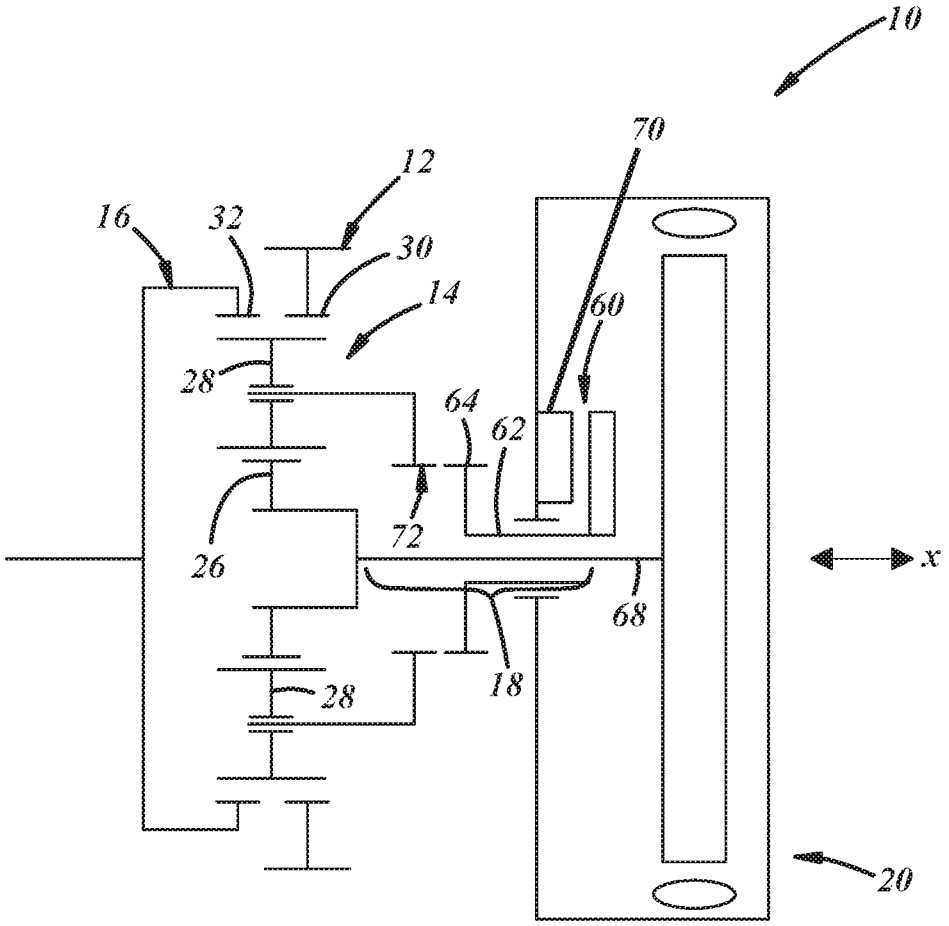
FIG. 3 is a block diagram depicting an implementation of an electrically-actuated camshaft phaser and an electrically-actuated lock.

An embodiment of a camshaft phaser 10 incorporating an electrically-actuated lock is shown with respect to FIGS. 1-3. The phaser 10 is a multi-piece mechanism with components that work together to transfer rotation from the engine's crankshaft and to the engine's camshaft, and that can work together to angularly displace the camshaft relative to the crankshaft for advancing and retarding engine valve opening and closing. The phaser 10 can have different designs and constructions depending upon, among other possible factors, the application in which the phaser is employed and the crankshaft and camshaft that it works with. In the embodiment presented in FIGS. 1-3, for example, the phaser 10 includes a sprocket 12, a planetary gear assembly 14, an inner plate 16, and an electrically-actuated lock 18 that includes an electric motor 20.

The sprocket 12 receives rotational drive input from the engine's crankshaft and rotates about an axis $X_1$. A timing chain or a timing belt can be looped around the sprocket 12 and around the crankshaft so that rotation of the crankshaft translates into rotation of the sprocket 12 via the chain or belt. Other techniques for transferring rotation between the sprocket 12 and crankshaft are possible. Along an outer surface, the sprocket 12 has a set of teeth 22 for mating with the timing chain, with the timing belt, or with another component. In different examples, the set of teeth 22 can include thirty-eight individual teeth, forty-two individual teeth, or some other quantity of teeth spanning continuously around the circumference of the sprocket 12. As illustrated, the sprocket 12 has a housing 24 spanning axially from the set of teeth 22. The housing 24 is a cylindrical wall that surrounds parts of the planetary gear assembly 14.

In the embodiment presented here, the planetary gear assembly 14 includes a sun gear 26, planet gears 28, a first ring gear 30, and a second ring gear 32. The sun gear 26 is driven by the electric motor 20 for rotation about the axis $X_1$. The sun gear 26 engages with the planet gears 28 and has a set of teeth 34 at its exterior that makes direct teeth-to-teeth meshing with the planet gears 28. In different examples, the set of teeth 34 can include twenty-six individual teeth, thirty-seven individual teeth, or some other quantity of teeth spanning continuously around the circumference of the sun gear 26. A skirt 36 in the shape of a cylinder spans from the set of teeth 34. As described, the sun gear 26 is an external spur gear, but could be another type of gear.

The planet gears 28 rotate about their individual rotational axes $X_2$ when in the midst of bringing the engine's camshaft among advanced and retarded angular positions. When not advancing or retarding, the planet gears 28 revolve together around the axis $X_1$ with the sun gear 26 and with the ring gears 30, 32. In the embodiment presented here, there are a total of three discrete planet gears 28 that are similarly designed and constructed with respect to one another, but there could be other quantities of planet gears such as two or four or six. However many there are, each of the planet gears 28 can engage with both of the first and second ring gears 30, 32, and each planet gear can have a set of teeth 38 along its exterior for making direct teeth-to-teeth meshing with the ring gears. In different examples, the teeth 38 can include twenty-one individual teeth, or some other quantity of teeth spanning continuously around the circumference of each of the planet gears 28. To hold the planet gears 28 in place and support them, a carrier assembly 40 can be provided. The carrier assembly 40 can have different designs and constructions. In the embodiment presented in the figures, the carrier assembly 40 includes a first carrier plate 42 at one end, a second carrier plate 44 at the other end, and cylinders 46 that serve as a hub for the rotating planet gears 28. Planet pins or bolts 48 can be used with the carrier assembly 40.

The first ring gear 30 receives rotational drive input from the sprocket 12 so that the first ring gear 30 and sprocket 12 rotate together about the axis $X_1$ in operation. The first ring gear 30 can be a unitary extension of the sprocket 12—that is, the first ring gear 30 and the sprocket 12 can together form a monolithic structure. The first ring gear 30 has an annular shape, engages with the planet gears 28, and has a set of teeth 50 at its interior for making direct teeth-to-teeth meshing with the planet gears 28. In different examples, the teeth 50 can include eighty individual teeth, or some other quantity of teeth spanning continuously around the circumference of the first ring gear 30. In the embodiment presented here, the first ring gear 30 is an internal spur gear, but could be another type of gear.

The second ring gear 32 transmits rotational drive output to the engine's camshaft about the axis $X_1$. In this embodiment, the second ring gear 32 drives rotation of the camshaft via the plate 16. The second ring gear 32 and plate 16 can be connected together in different ways, including by a cutout-and-tab interconnection, press-fitting, welding, adhering, bolting, riveting, or by another technique. In embodiments not illustrated here, the second ring gear 32 and the plate 16 could be unitary extensions of each other to make a monolithic structure. Like the first ring gear 30, the second ring gear 32 has an annular shape, engages with the planet gears 28, and has a set of teeth 52 at its interior for making direct teeth-to-teeth meshing with the planet gears. In different examples, the teeth 52 can include seventy-seven individual teeth, or some other quantity of teeth spanning continuously around the circumference of the second ring gear 32. With respect to each other, the number of teeth between the first and second ring gears 30, 32 can differ by a multiple of the number of planet gears 28 provided. So, for instance, the teeth 50 can include eighty individual teeth, while the teeth 52 can include seventy-seven individual teeth—a difference of three individual teeth for the three planet gears 28 in this example. In another example with six planet gears, the teeth 50 could include seventy individual teeth, while the teeth 52 could include eighty-two individual teeth. Satisfying this relationship furnishes the advancing and retarding capabilities by imparting relative rotational movement and relative rotational speed between the first and second ring gears 30, 32 in operation. In the embodiment presented here, the second ring gear 32 is an internal spur gear, but could be another type of gear. The plate 16 includes a central aperture 54 through which a center bolt 56 passes to fixedly attach the plate 16 to the camshaft. In addition, the plate 16 is also be secured to the sprocket 12 with a snap ring 58 that axially constrains the planetary gear assembly 14 between the sprocket 12 and the plate 16.

Together, the two ring gears 30, 32 constitute a split ring gear construction for the planetary gear assembly 14. However, other implementations of electrically-controlled camshaft phasers could be used with the electrically-controlled lock. For example, the planetary gear assembly 14 could include an eccentric shaft and a compound planet gear used with first and second ring gears.

In this implementation, a solenoid 60 is included with the electric motor 20. The solenoid 60 includes an armature 62 that is coupled to a portion of a mechanical connection that is implemented as a solenoid gear 64 having radially-outwardly facing gear teeth 66. While the solenoid 60 here is included within an enclosure that includes the electric motor 20, the armature can extend outside of the enclosure and couple with the solenoid gear 64 outside of the enclosure. In addition, the armature 62 can be connected to the output shaft 68 of the electric motor 20 via a key included in the shaft 68 yet also remain in close proximity to a coil 70 of the solenoid included within the enclosure of the electric motor 20. As the output shaft 68 rotates the armature 62 can rotate as well. Another part of the mechanical connection includes a locking ring gear 72. The locking ring gear 72 can include a plurality of radially-inwardly facing gear teeth 74 that are sized to engage the radially-outwardly facing gear teeth 66 of the solenoid gear 64. The locking ring gear 72 can be rigidly coupled with the first carrier plate 42 so that the solenoid gear 64 slidably engages the ring gear 72 and prevents the relative rotation of the output shaft 68 relative to the carrier assembly 40.

The armature 62 can move linearly along the axis of camshaft rotation in response to the receipt of electrical current at the coil 70 from a power supply (not shown). The armature 62 can move from a first position in which the solenoid gear 64 and the locking ring gear 72 are linearly separated. In the first position, the output shaft 68 and the carrier assembly 40 can move relatively about the axis of camshaft rotation such that the angular position of the camshaft can vary relative to the angular position of the crankshaft. A microcontroller can open a switch that regulates the supply of current to the solenoid 60, flowing current through the coil 70 and moving the armature 62 to a second position in which the solenoid gear 64 engages the locking ring gear 72. This prevents the relative rotation or angular displacement of the output shaft 68 relative to the carrier assembly 40 and thereby the angular displacement of the camshaft relative to the crankshaft. Given the plurality of gear teeth extending along the outer periphery of the solenoid gear 64 and the inner periphery of the locking ring gear 72, the solenoid gear 64 can be engaged with the ring gear 72 at any point along the range of authority for the camshaft phaser. When the microcontroller closes the switch, electrical current is no longer supplied to the coil 70 and the armature 62 returns to the first position, which disengages the solenoid gear 64 from the locking ring gear 72.

The oil supply can be provided by an oil pump of the ICE that pressurizes oil obtained from an input tube located in an oil sump (not shown) and conveys the oil to various locations within the ICE, such as the crankshaft bearing journals, input/output valves, and the camshaft, to name a few.

The opening and closing of the switch and operation of the electric phaser motor can be controlled by a microprocessor or a control system. The control system can include one or more microprocessors, a memory device that includes computer-readable memory, and an input/output device for receiving sensor data from one or more sensors and transmitting computer-readable instructions from the control system to various types of hardware, such as the electric motor 20 and the switch. The microprocessor can be any type of device capable of processing electronic instructions including microcontrollers, host processors, controllers, vehicle communication processors, and application specific integrated circuits (ASICs). It can be a dedicated processor used only for controlling the electric motor 20 and/or the switch or can be shared with other vehicle systems. The microprocessor executes various types of digitally-stored instructions, such as software or firmware programs stored in memory the memory device, which enable the camshaft phaser 10 to operate. The sensors can include a camshaft position sensor and a crankshaft position sensor (not shown). The input/output can be linked to the electric motor 20, the switch, and/or the sensors in any one of a variety of network connections, such those carried out using a vehicle bus. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. An electrically-actuated camshaft phaser, comprising:

a planetary gear assembly including a camshaft ring gear configured to be connected to a camshaft, a sprocket ring gear configured to receive rotational input from a crankshaft, and one or more planet gears engaging the camshaft ring gear and the sprocket ring gear, wherein the planetary gear assembly changes an angular position of the camshaft relative to the crankshaft; and an electric motor, coupled to the planetary gear assembly, and a solenoid, wherein the electric motor controls the angular position of the camshaft relative to the crankshaft, and the solenoid selectively moves an electrically-actuated lock into locking engagement thereby preventing movement of the camshaft relative to the crankshaft.

2. The electrically-actuated camshaft phaser recited in claim 1, wherein the electrically-actuated lock comprises a solenoid gear and a locking ring gear.

3. The electrically-actuated camshaft phaser recited in claim 1, wherein the solenoid and the electric motor are arranged within an enclosure.

4. The electrically-actuated camshaft phaser recited in claim 1, wherein the solenoid comprises an armature connected to an output shaft of the electric motor.

5. The electrically-actuated camshaft phaser recited in claim 1, wherein the electrically-actuated lock comprises a dog clutch, a tapered tooth face clutch, a friction clutch, or a lock pin.

6. The electrically-actuated camshaft phaser recited in claim 1, further comprising a linkage between the solenoid and the electrically-actuated lock.

7. The electrically-actuated camshaft phaser recited in claim 6, wherein the linkage comprises a hydraulic pathway.

8. The electrically-actuated camshaft phaser recited in claim 1, further comprising a valve, controlled by an armature of the solenoid, that flows lubricating fluid to the electrically-actuated camshaft phaser in a first position of the armature.

9. The electrically-actuated camshaft phaser recited in claim 8, wherein the solenoid selectively moves the armature to a second position that stops the flow of lubricating fluid and a third position that both stops the flow of lubricating fluid and places the electrically-actuated lock in a locked position.

10. The electrically-actuated camshaft phaser recited in claim 1, wherein the solenoid is located apart from the electric motor.

11. The electrically-actuated camshaft phaser recited in claim 1, wherein the solenoid includes an armature configured to rotate.

* * * * *